US010928069B2

(12) United States Patent
Stastny et al.

(10) Patent No.: US 10,928,069 B2
(45) Date of Patent: Feb. 23, 2021

(54) SMALL EXIT DUCT FOR A REVERSE FLOW COMBUSTOR WITH INTEGRATED FASTENING ELEMENTS

(71) Applicant: Pratt & Whitney Canada Corp., Longueuil (CA)

(72) Inventors: Honza Stastny, Georgetown (CA); Robert Sze, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 774 days.

(21) Appl. No.: 15/185,310

(22) Filed: Jun. 17, 2016

(65) Prior Publication Data

US 2017/0363296 A1 Dec. 21, 2017

(51) Int. Cl.
*F23R 3/60* (2006.01)
*F23R 3/54* (2006.01)

(52) U.S. Cl.
CPC . *F23R 3/60* (2013.01); *F23R 3/54* (2013.01)

(58) Field of Classification Search
CPC .... F23R 3/54; F23R 3/60; F23R 2900/03042; F23R 2900/03044; F23R 2900/03045
See application file for complete search history.

(56) References Cited

U.S. PATENT DOCUMENTS

| | | | | |
|---|---|---|---|---|
| 5,435,139 | A * | 7/1995 | Pidcock | F23R 3/002 60/752 |
| 6,269,628 | B1 * | 8/2001 | Gates | F01D 9/023 60/804 |
| 7,350,358 | B2 | 4/2008 | Patel et al. | |
| 8,116,767 | B2 | 5/2012 | Grivas et al. | |
| 8,245,514 | B2 * | 8/2012 | Tu | F01D 9/023 60/39.37 |
| 2012/0328996 | A1 * | 12/2012 | Shi | F23R 3/007 431/253 |
| 2014/0366544 | A1 | 12/2014 | MacCaul et al. | |
| 2015/0059349 | A1 * | 3/2015 | Patel | F23R 3/002 60/772 |
| 2015/0075172 | A1 * | 3/2015 | Stuttaford | F23R 3/14 60/772 |

* cited by examiner

*Primary Examiner* — Todd E Manahan
*Assistant Examiner* — Katheryn A Malatek
(74) *Attorney, Agent, or Firm* — Norton Rose Fulright Canada LLP

(57) ABSTRACT

The described reverse flow combustor of a gas turbine engine includes inner and outer combustor liners defining a combustor chamber therewithin. A large exit duct and a small exit duct are disposed at downstream ends of the outer and inner liner respectively. The small exit duct includes an annular ring removably mounted to a support element of the gas turbine engine by one or more fastening elements that are integrally formed with the annular ring. The fastening elements are mountable with corresponding features of the support element and removably fastened thereto.

11 Claims, 3 Drawing Sheets

SMALL EXIT DUCT FOR A REVERSE FLOW COMBUSTOR WITH INTEGRATED FASTENING ELEMENTS

TECHNICAL FIELD

The application relates generally to gas turbine engine combustors and, more particularly, to a reverse flow combustor of a gas turbine engine.

BACKGROUND

Reverse flow combustors for gas turbine engines typically include large and small exit ducts which are configured to reverse the flow of the hot combustion gases, between an upstream end of the combustor where the fuel nozzles are located to the downstream end of the combustor which is in fluid flow communication with the downstream turbine(s). In a reverse flow combustor, the small exit duct is often most susceptible to wear and/or lifecycle issues because its geometry and location in the combustor requires it to have a tight radius bend with more limited surface area available for air cooling and the like. Current designs of small exit ducts typically use ductile sheet metal to form the small exit duct, in order to overcome manufacturing challenges associated with the tight radius design. However, ductile materials are normally less durable than other components used in gas turbine engines, such as machined components and like.

Additionally, because most small exit ducts are either integrally formed with the liners of the reverse flow combustors or welded in place thereto, in the event that a small exit duct needs replacement it may become necessary to scrap the entire combustor or at least large portions thereof.

Improvements in reverse flow combustors are therefore sought.

SUMMARY

There is accordingly provided a reverse flow combustor a reverse flow combustor of a gas turbine engine comprising: inner and outer combustor liners defining a combustor chamber therewithin; a large exit duct disposed at a downstream end of the outer liner forming a continuation of the outer liner; and a small exit duct disposed at and communicating with a downstream end of the inner liner, the small exit duct and the large exit duct cooperating to define a reverse flow exit passage therebetween that is configured to communicate with a turbine section of the gas turbine; wherein the small exit duct is removably fastened to a support element, the small exit duct including an annular ring having an outer surface facing the combustion chamber and extending downstream from the inner combustor liner, the annular ring being removably mounted to the support element of the gas turbine engine by one or more fastening elements integrally formed with the annular ring, the fastening elements being mountable with corresponding features of the support element and removably fastened thereto.

There is also provided a small exit duct for a reverse flow combustor of a gas turbine engine, the small exit duct comprising an annular ring having an arcuate cross-section and defining an outer convex surface and an opposite inner concave surface, and a plurality of mounting studs extending from the inner concave surface of the annular ring, the mounting studs being integrally formed with the annular ring to form a monolithic unitary structure of the small exit duct, the mounting studs being configured to be removably fastened to corresponding features of a support element, the small exit duct being thereby removably mountable in place within the reverse flow combustor.

There is additionally provided a method of forming a reverse flow combustor of a gas turbine engine a method of forming a reverse flow combustor of a gas turbine engine, the method comprising: providing a small exit duct having an annular ring and one or more fastening elements integrally formed thereon; and positioning the small exit duct downstream of an inner liner of the reverse flow combustor such that an outer surface of the annular ring faces a combustion chamber of the reverse flow combustor, and removably fastening the small exit duct in place by mating the fastening elements of the small exit duct with corresponding features in a support element of the reverse flow combustor.

The method as described above may further include providing at least one heat shield panel on a hot side of the inner liner, and spacing the heat shield panel apart from the inner liner to define an annular gap therebetween, the annular gap providing a film of cooling air along at least a portion of an outer surface of the cast annular ring. Further, a sealing ring may also be provided between the inner liner and the cast small exit duct, and an outlet of the annular gap may be formed using the sealing ring. Further still, the method may also include controlling a flow of the film of cooling air using slats disposed at the opening of the annular gap.

The method as described above may also include the steps of attaching the support element to the inner liner to define a passage between the cast annular ring and the support element, and providing the support element with apertures defined therethrough to allow impingement airflow into the passage through the apertures for cooling the cast small exit duct.

There is further provided a method of repairing a reverse flow combustor of a gas turbine engine having a large exit duct and a small exit duct respectively disposed at downstream ends of outer and inner combustor liners, the method comprising: detaching one or more fastening elements removably connecting the small exit duct to an associated support element; removing the small exit duct from a remainder of the reverse flow combustor without damaging or removing at least the large exit duct; and replacing the removed small exit duct by a new small exit duct, by position the new small exit duct in place within the reverse flow combustor and fastening said new small exit duct to said associated support element using fastening elements integrally formed with the new small exit duct.

BRIEF DESCRIPTION OF THE DRAWINGS

Reference is now made to the accompanying figures in which.

DETAILED DESCRIPTION

Figure 1:
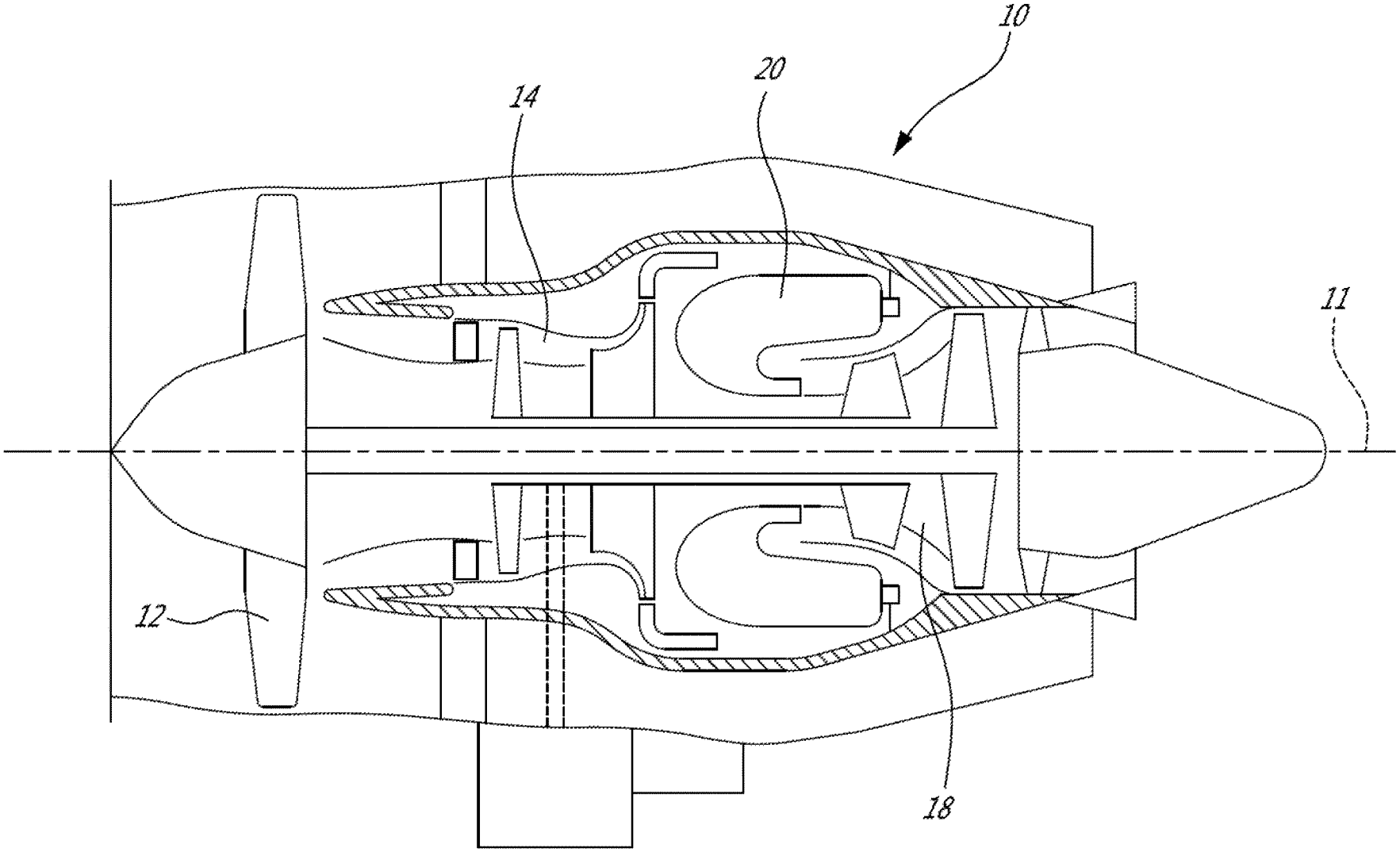
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 20 in which the compressed air is mixed with fuel and ignited for generating an annular stream of hot combustion gases, and a turbine section 18 for extracting energy from the combustion gases.

Figure 2:
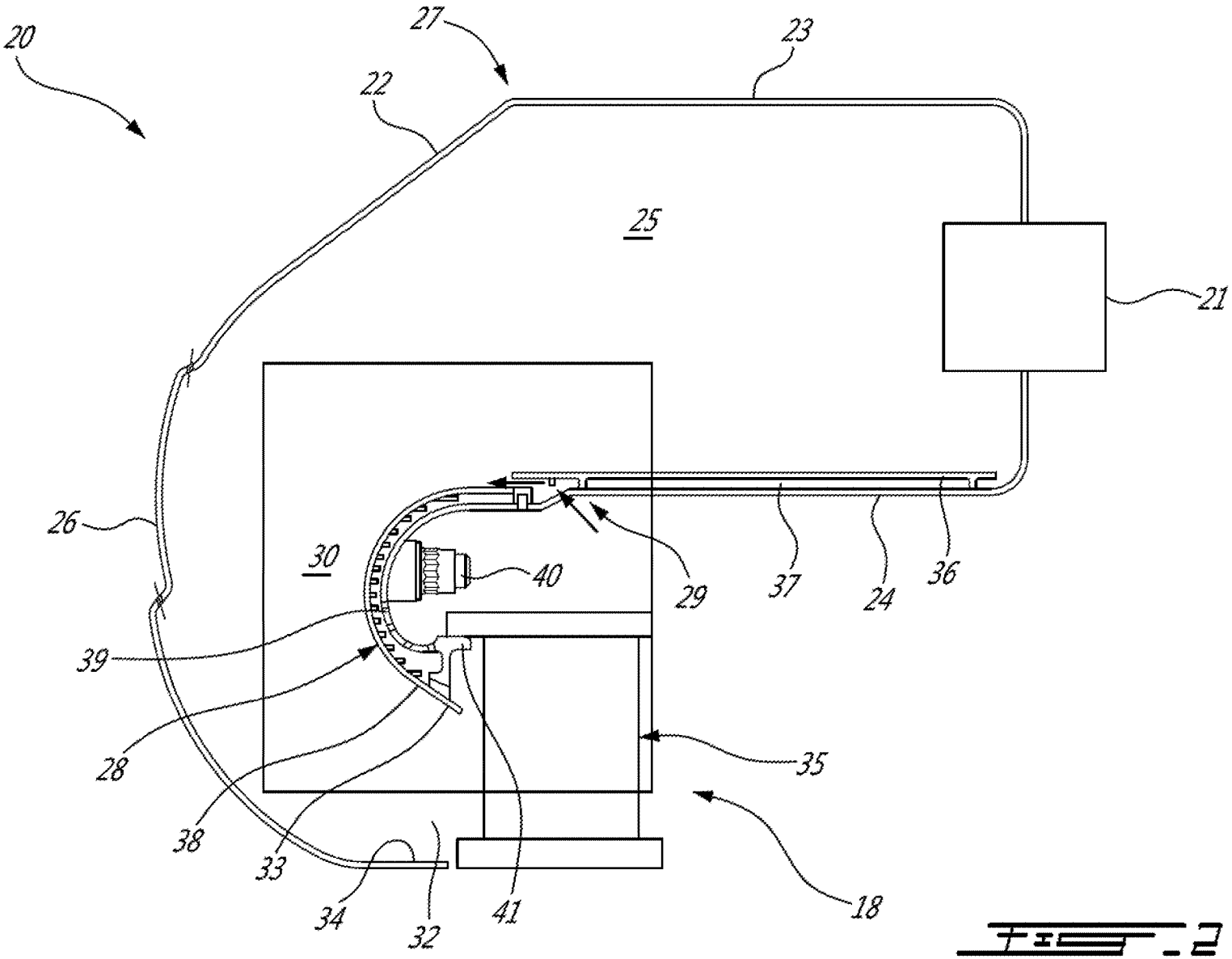
FIG. 2 is a schematic cross-sectional view of a reverse flow combustor of the gas turbine engine of FIG. 1, according to a particular embodiment of the present disclosure.

Referring to FIG. 2, a reverse flow combustor 20 of the gas turbine engine 10 according to an embodiment of the present disclosure is shown. The reverse flow combustor 20 includes a plurality of fuel nozzles 21. The fuel nozzles 21 are schematically shown as a box in FIG. 2, however, the fuel nozzles 21 can be circumferentially spaced apart to spray fuel into the reverse flow combustor 20. Other arrangements of the fuel nozzles 21 are also possible. The reverse flow combustor 20 includes a shell 22 having an outer 23 and inner 24 combustor liners. The outer and inner combustor liners 23, 24 are spaced apart and define a combustion chamber 25 between them. The inner 24 and outer 23 shells may be, in the embodiment shown, fastened together by a mechanical device or fastener(s). In the embodiment shown, the outer and inner combustor liners 23, 24 are annular and concentrically disposed thereby defining therebetween a portion of the combustion chamber 25. The outer 23 and/or inner 24 liners can have different forms and shapes. The outer and inner liners 23, 24 can be made from sheet metals and the like.

The reverse flow combustor 20 also includes a large exit duct 26 located at a downstream end 27 of the outer liner 23 and a removable small exit duct 28 located at a downstream end 29 of the inner liner 24. The large and small exit ducts 26, 28 form part of the shell 22 and cooperate together to define a reverse flow exit passage 30 between them. In the embodiment shown, the large and small exit ducts 26, 28 are spaced apart to define the reverse flow passage 30 of the combustion chamber 25. In the embodiment shown, the large exit duct 26 forms a continuation of the outer liner 23. The large exit duct 26 can be connected to the outer liner 23 by welding, for example, or may alternately be integrally formed therewith. In an alternate embodiment, the large exit duct 26 can be monolithically formed as a single sheet metal structure with the outer liner 23. The large and small exit ducts 26, 28 are bent such that the reverse flow passage 30 curves inwardly through approximately 180 degrees to discharge the stream of hot combustion gases to the turbine section 18 through an outlet 32 of the combustion chamber 25. The outlet 32 of the combustion chamber 25 is defined between a downstream end 33 of the small exit duct 28 and a downstream end 34 of the large exit duct 26. In a particular embodiment, the stream of combustion gases is discharged to high pressure turbine vanes 35, of which only one is shown.

The reverse flow combustor 20 may include one or more heat shield panels 36 disposed on the hot side of the inner liner 24 and defining an annular gap or a path 37 between the inner liner 24 and the heat shield 36 for supplying a film of cooling air to cool the shell 22 of the reverse flow combustor 20, or part of it. The starter film is mainly introduced parallel to and along the inner 24 and/or outer 23 liners. The path 37, as shown in FIG. 3, can be an annulus formed between the annular heat shield panel(s) 36 and the inner liner 24.

In the embodiment shown, the small exit duct 28 forms a continuation of the inner liner 24. The small exit duct 28 however includes a removable annular ring 38 mounted to a support element 39 of the gas turbine engine 10 via one or more fastening elements which are integrally formed with the annular ring 38. The fastening elements can include, but not limited to, clamps or the like. In the embodiment shown, the fastening elements are provided as mounting studs 40. The annular ring 38 and the mounting studs 40 can be simultaneously and integrally formed, and as such, the annular ring 38 and the mounting studs 40 may be integrally formed to create a single monolithic structure. The annular ring 38 and the mounting studs 40 of the small exit duct 28 may be formed by one of casting, metal injection molding (MIM) or additive manufacturing (such as 3D printing, etc.). The support element 39 can be any structure within the turbine engine 10 for mounting the annular ring 38 relative to the inner liner 24 within the combustion chamber 25. In the embodiment shown, the support element 39 forms an integral portion of the inner liner 24 and include a seat 41 abutting a portion of the high pressure turbine vane 35 in a sliding joint configuration.

Figure 3:
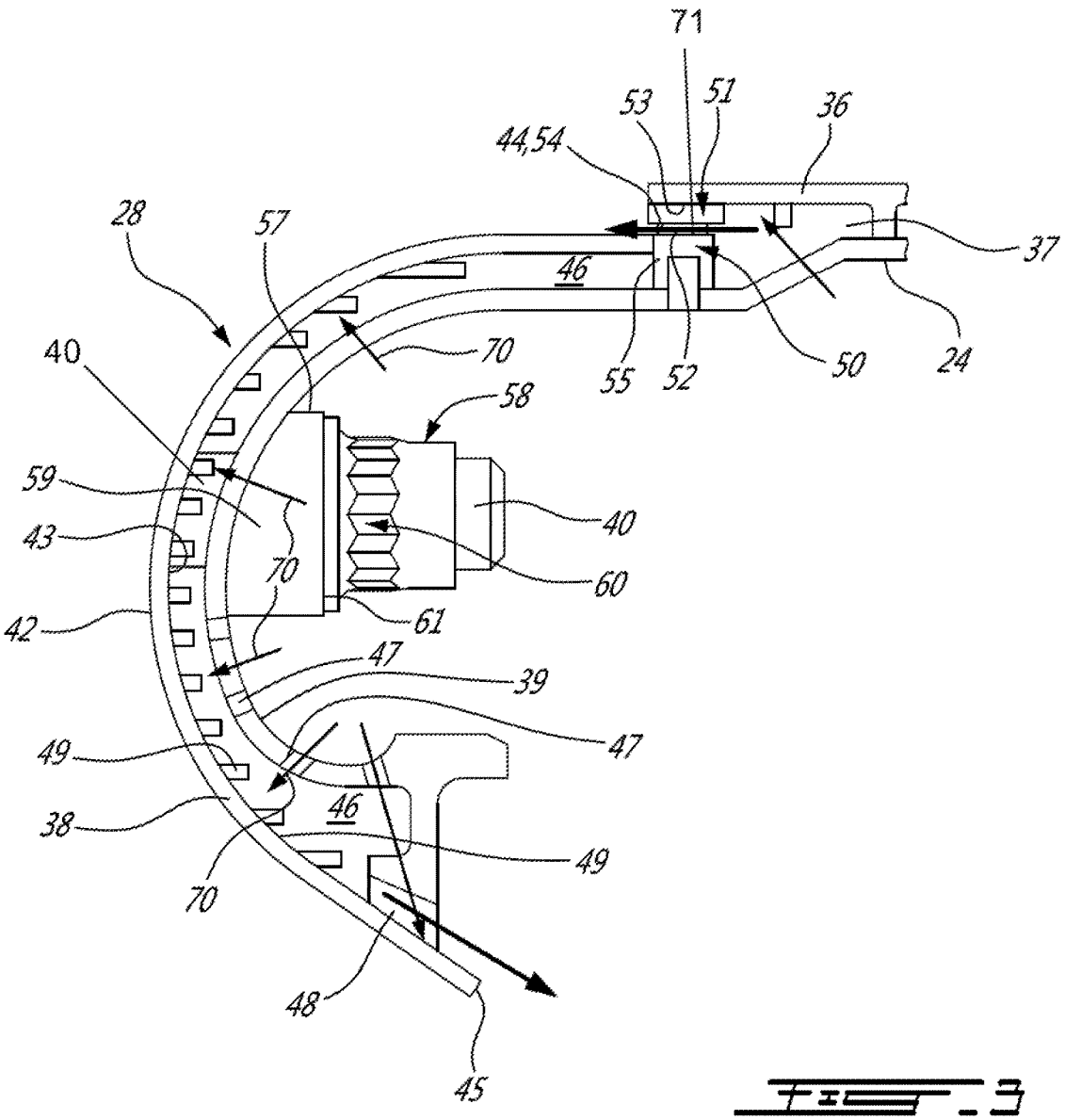
FIG. 3 is an enlarged cross-sectional view of a small exit duct of the reverse flow combustor of FIG. 2.

Referring to FIG. 3, an enlarged view of the removable small exit duct 28 is shown. The annular ring 38 of the small exit duct 28 has an arcuate cross-section defining an outer convex surface 42 and an opposite inner concave surface 43. The outer convex surface 42 faces the large exit duct 26 and is generally subjected to higher temperatures than the support element 39. The annular ring 38 extends between an outer lip 44 adjacent to the panel 36 and an opposite inner lip 45 adjacent to the outlet 32 of the combustion chamber 25. The outer lip 44 is located radially outward from the inner lip 45. The annular ring 38 can be made from a high oxidation resistance castable material. Advantageously, the removable small exit duct 28 can be coated in a vacuum chamber for advanced suspended plasma spray (SPS) and/or low pressure plasma spray (LPPS). These spraying techniques may improve the durability of the small exit duct 28. The outer convex surface 42 of the cast annular ring 38 can be coated with a ceramic coating such as the low pressure plasma spray in vacuum, suspended plasma spray (SPS), high velocity oxy fuel (hvof), or the like. The inner concave surface 43 can be coated with an aluminide coating.

The annular ring 38 is spaced apart from the support element 39 to define a cooling passage 46 between them, since the annular ring 38 is generally exposed to higher temperatures than the support element 39. The passage 46 has a proximate end adjacent to the outer lip 44 and distal end adjacent to the inner lip 45 of the cast annular ring 38. The support element 39 has apertures 47 defined therein to allow impingement airflow into the passage 46 through the apertures 47 for cooling the inner concave surface 43 of the cast annular ring 38. In one particular embodiment, for example, each one of the apertures 47 has a diameter between 0.02 and 0.1 inch. Impingement airflow is directed through the apertures 47 defined through the support element 39 and impinges on the inner concave surface 43 of the small exit duct 28. The impingement airflow is relatively cool and thus serves to cool the small exit duct 28 which is exposed to the combustion gases produced during combustion. Impingement jets can be used to deliver the impingement airflow. In a particular embodiment, the impingement jets are grouped to concentrate the impingement airflow on hotter areas of the small exit duct 28. The impingement airflow exits the passage 46 through an outlet 48 defined between the cast annular ring 38 and the support element 39 downstream of the reverse flow passage 30 towards the high pressure turbine vanes 35 for external film cooling thereof.

In the embodiment shown, the annular ring 38 includes cooling elements 49 extending away from the inner concave surface 43. The cooling elements 49 can be integrally cast with the annular ring 38 to form a single piece. Advantageously, the cooling elements 49 may improve the cooling of the small exit duct 28. In one particular embodiment, these cooling elements 49 may include, but not limited to, a plurality of cooling pins and/or ribs, or the like. These cooling elements 49 are thus integrally formed with the annular ring and extend away from the inner surface 43 thereof, and thereby increase (i.e. relative to a corresponding shaped and sized small exit duct annular ring 38 that is devoid of any cooling elements thereon) the effective surface area of the inner surface 43. This inner surface 43 having the cooling elements 49 therein is adapted to be cooled by a plurality of cooling impingement airflows 70, flowing through the impingement cooling holes 47 in the support element 39 as described above.

The height of the cooling elements 49 can vary depending on the application and/or operating conditions of the gas turbine engine 10, and the manufacturability of casting the cooling element 49. In general, these cooling elements 49 do not have to be full channel height and therefore to facilitate the extraction of the casting dyes, it is desirable to have reduced height pins or ribs.

The reverse flow combustor 20 includes a sealing ring 50 mounted to the inner liner 24, between the path 37 of the starter film and the passage 46 of the impingement airflow, to seal the proximate end of the passage 46 and to define an outlet 51 of the path 37 between an outer surface 52 of the sealing ring 50 and an inner surface 53 of the panel 36. The sealing ring 50 is, in one particular embodiment, a forged ring welded to the inner liner 24 by electron beam welding, for example. The outer lip 44 of the cast annular ring 38 has a surface 54 sealingly abutted to a surface 55 of the sealing ring 50 to form a single sealing interface between the cast annular ring 38 and the sealing ring 50. The surface 54 of the outer lip 44 can be ground to a tight tolerance together with the surface 55 of the sealing ring 50 to provide positive sealing under most operating conditions. In a particular embodiment, the small exit duct 28 is a single casting without radial ridges along its length so that the surface 44 is the only line of contact with the sealing ring 50 via surface 54. Advantageously, this arrangement provides positive sealing. Other arrangements including multiple contact designs may include ridges and therefore may not be suitable to provide a positive sealing because of casting tolerances associated with the ridges and profile tolerances thereof. In the embodiment shown, the outlet 51 of the path 37 includes an opening with sloping slats 71 for controlling a flow of the starter film and directing the starter film towards the small exit duct 28. In an alternate embodiment, the opening of the path can include a slotted louver with wiggle strips.

In the embodiment shown, the cast annular ring 38 includes the mounting studs 40 which are integrally formed and cast with the cast annular ring 38 to form a unitary, monolithic, and thus fully integral structure. The mounting studs 40 can include any elongated member to secure the cast annular ring 38 to the support element 39, such as a threaded or unthreaded rod, shaft or the like. The mounting studs 40 extend away from the inner concave surface 43 and are sized to fit into corresponding mounting features, shown as mounting openings 57 of the support element 39. The mounting features can include any other appropriate element. A shank 58 of each mounting stud 40 extends through the corresponding mounting opening 57. In the embodiment shown, the mounting opening 57 includes a sleeve 59 extending away from the support element 39 and a nut 60 inserted around a portion of the shank 58 and abutting an end surface 61 of the sleeve 59 to secure the mounting stud 40 relative to the mounting opening 57. The number of studs 40 used for mounting the cast annular ring 38 to the support element 39 can vary, and may depend on the width, length and/or material of the mounting studs 40 and/or the size of the engine and thus that of the small exit duct. In a particular embodiment, the number of mounting studs 40 is at least equal to the number of fuel nozzles 21. In an alternate embodiment, the number of the mounting studs 40 used can vary from half to equal the number of fuel nozzles 21.

Other attachment mechanism of the cast annular ring 38 to the support element 39 can be used, including, but not limited to, clamps. In an alternate embodiment, the annular ring 38 integrally includes sleeves for receiving studs or other mounting members. The studs or mounting members can be provided as part of the support element 39 or separately.

In use, because the small exit duct 28 is removably fastened in place on the combustor 20, the small exit duct 28 can be removed from the support element 39 by removing the nuts 60 and/or other securing elements, if used, and removing the mounting studs 40 from the corresponding mounting openings 57 of the support element 39. The entire small exit duct 28 can thus be removed entirely from the remainder of the combustor 20. This can be advantageous for maintenance and/or overhaul operations, without requiring the entire combustor to be disassembled and/or scraped simply in order to repair and/or replace the small exit duct. Therefore, the small exit duct 28 as described herein can be removed from the combustor 20 without causing any damage to any of the components and replaced without needing to replace the associated inner liner 24 or other components of the reverse flow combustor 20.

In a particular embodiment, the small exit duct 28 is installed on the reverse flow combustor 20 by removably attaching the small exit duct 28 to the support element 39 using the fastening elements, for example mounting studs 40 and securing them on the corresponding features, for example the mounting openings 57 of the support element 39. The installation also include abutting the outer lip 44 to the side surface 55 of the sealing ring 50 and aligning and leveling the outer convex surface 42 with the outer surface 52 of the sealing ring 50 to avoid a step in the flow path of the starter film. Advantageously, the outer convex surface 42 is positioned to fit flush with the outer surface 52 of the sealing ring 50 to prevent the starter film to deflect.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A reverse flow combustor of a gas turbine engine comprising:

inner and outer liners defining a combustor chamber therewithin;

a large exit duct disposed at a downstream end of the outer liner forming a continuation of the outer liner;

a small exit duct disposed at and communicating with a downstream end of the inner liner, the small exit duct and the large exit duct cooperating to define an outlet of the combustion chamber therebetween that is configured to communicate with a turbine section of the gas turbine, the turbine section including high pressure turbine vanes located immediately downstream of the outlet of the combustion chamber;

at least one heat shield panel disposed in the combustion chamber and spaced apart from the inner liner thereby defining an annular gap therebetween; and a sealing ring disposed between the inner liner and the small exit duct, the sealing ring defining an outlet of the annular gap wherein the small exit duct is removably fastened to a support element, the small exit duct including an annular ring having an outer surface facing the combustion chamber and extending downstream from an outer lip to an opposite inner lip, the annular gap configured for providing a film of cooling air along at least a portion of the outer surface of the annular ring, the outer lip of the annular ring located adjacent to the inner combustor liner and the inner lip of the annular ring located adjacent to the outlet of the combustion chamber, at least the inner lip of the annular ring at a downstream end of the small exit duct being in detachable engagement with the support element, the inner lip of the annular ring and a most downstream end of the support element terminating upstream of leading edges of the high pressure turbine vanes, and one or more fastening elements integrally formed with the annular ring, the fastening elements being removably fastened to mating features of the support element for removably mounting the annular ring to the support element.

2. The reverse flow combustor of claim 1, wherein the annular ring and the fastening elements are cast as a single piece to form a fully cast small exit duct.

3. The reverse flow combustor of claim 1, wherein the fastening elements include one or more studs projecting from an inner surface of the annular ring, and the mating features of the support element include mounting openings cooperating with the one or more studs.

4. The reverse flow combustor of claim 1, wherein the support element forms an integral portion of the inner combustor liner.

5. The reverse flow combustor of claim 1, wherein the outlet of the annular gap includes an opening with slats for controlling a flow of the film of cooling air.

6. The reverse flow combustor of claim 1, wherein an end of the annular ring abuts the sealing ring and forms a single sealing interface with the sealing ring, the outer surface of the annular ring being leveled and aligned with an outer top surface of the sealing ring.

7. The reverse flow combustor of claim 1, wherein the support element forms a continuation of the inner liner and is spaced apart from the annular ring thereby defining a passage therebetween, the support element including apertures defined therein which allow impingement airflow into the passage through the apertures.

8. The reverse flow combustor of claim 1, wherein the annular ring has a ceramic or aluminide coating on at least a portion thereof for insulation and oxidation resistance.

9. A small exit duct for a reverse flow combustor of a gas turbine engine, the small exit duct comprising an annular ring removably fastened to a support element, the annular ring having an arcuate cross-section and defining an outer convex surface and an opposite inner concave surface, and a plurality of mounting studs extending from the inner concave surface of the annular ring, the mounting studs being integrally formed with the annular ring to form a monolithic unitary structure of the small exit duct, the mounting studs being removably fastened to mating features of the support element, the small exit duct being thereby removably mountable in place within the reverse flow combustor, wherein the annular ring extends between an outer lip and an inner lip, the outer lip being disposed radially outward from the inner lip and having a surface configured to sealingly abut a sealing ring of the reverse flow combustor forming a single sealing interface with the sealing ring, the outer convex surface of the annular ring being leveled and aligned with an outer top surface of the sealing ring, and the inner lip of the annular ring at a downstream end of the small exit duct defining an exit of the reverse flow combustor.

10. The small exit duct of claim 9, wherein the annular ring and the mounting studs are cast as a single piece to form a fully cast small exit duct.

11. The small exit duct of claim 9, wherein the annular ring has a ceramic or aluminide coating on at least a portion thereof which provides insulation and oxidation resistance.

* * * * *